United States Patent [19]

Mauer

[11] Patent Number: 4,793,391

[45] Date of Patent: Dec. 27, 1988

[54] STRIPPER DEVICE FOR LOG SPLITTERS

[76] Inventor: James J. Mauer, 5513 Hilldale Dr., Racine, Wis. 53406

[21] Appl. No.: 190,409

[22] Filed: May 5, 1988

[51] Int. Cl.[4] ..... B27L 7/00; B26D 7/06

[52] U.S. Cl. ..... 144/193 A; 83/111; 144/366

[58] Field of Search ..... 144/193 R, 193 A, 366; 83/111

[56] References Cited

U.S. PATENT DOCUMENTS

| | | | |
|---|---|---|---|
| 3,640,323 | 2/1972 | Heile | 144/193 A |
| 4,061,168 | 12/1977 | Fariss, Jr. | 144/193 R |
| 4,428,409 | 1/1984 | Roetzler | 144/193 A |
| 4,700,759 | 10/1987 | Duerr | 144/193 A |

*Primary Examiner*—W. Donald Bray
*Attorney, Agent, or Firm*—Peter N. Jansson, Ltd.

[57] ABSTRACT

A device for removal of a log from a log-splitter blade including a stripper member removably engaged to the log-splitter anvil member. The stripper member has distal and proximal ends and a front surface beveled upwardly from a lower edge at the distal end toward the proximal end such that the power of the log-splitter acts, through the beveled surface of the stripper member, on the free end of a log stuck on the blade to remove it from the blade. A preferred embodiment includes a notched front surface to help keep the free end engaged with the stripper member during removal of a log.

17 Claims, 2 Drawing Sheets

STRIPPER DEVICE FOR LOG SPLITTERS

FIELD OF THE INVENTION

This invention relates to apparatus for chopping and splitting logs and, more particularly, to log-splitting apparatus of the type having opposed blade and anvil members applied to opposite ends of a log and driven together with great force.

BACKGROUND OF THE INVENTION

Log splitters of the type applying log-splitting force on opposite ends of a log through opposed blade and anvil members are very well known. In such apparatus, the blade and anvil members are driven together with great force, often using hydraulic power or some other power means. Examples of log splitters are those disclosed in the following U.S. Pat. Nos.:

3,640,323 (Helle)
4,061,168 (Fariss)
4,428,409 (Roetzler).

Such log splitters, particularly those of the power-operated type, have the disadvantage that if the log fails to split, it may be jammed tightly onto the blade of the log splitter. By virtue of the great force generated in causing such jam, the log may be stuck so tightly onto the blade that it is extremely difficult to dislodge it. Removal is made all the more difficult by virtue of the fact that the log is in a position making manual application of removal force difficult at best.

Removal usually requires extraordinary steps or specific tools. For example, it may be necessary to obtain a crowbar or saw or some other tool to pry the log from the blade. Even with appropriate tools, removal operations are difficult and time-consuming and substantially delay the log splitting operation.

Before the splitter can be operated further, the log must be removed from the blade. Therefore, this problem can frequently cause interruption of log-splitting operations. And, since such operations are often in the field where a tool chest may not be available, a log-splitting expedition can even be cut short unless someone has a tool chest with the right tools available for removal of the log.

In some cases, tools which may be used for removal of a log from a log-splitter blade can cause various problems. For example, removal of a log can be quite difficult even with the help of a crowbar or the like. When wedges are used, they may get stuck in the log themselves; or the hammering of such wedges may cause damage to the blade or some other part of the log-splitting device. The use of a saw may cause damage to the saw itself unless extreme care is exercised.

OBJECTS OF THE INVENTION

It is an object of this invention to provide an accessory for log-splitting devices which overcomes certain problems and shortcomings of the prior art, including those mentioned above.

Another object of this invention is to provide a device allowing easy removal of logs from the blades of log-splitters.

Another object of this invention is to provide a device allowing the avoidance of excessive downtime in log-splitting operations caused by the jamming of logs on blades.

Another object of this invention is to provide a device for removing logs jammed on log-splitter blades which eliminates the use of saws, wedges, crowbars or the like for that purpose, and which eliminates the problems associated with log removal with such tools.

Another object of this invention is to provide a device for removing logs jammed on log-splitter blades which harnesses the power of the log-splitting apparatus itself for that purpose.

These and other important objects will be apparent from the descriptions of this invention which follow.

SUMMARY OF THE INVENTION

This invention overcomes the shortcomings and problems of the prior art by using the power of the log splitter itself to remove a log that is jammed on the blade. The invention is a device for removal of a log from a log-splitter blade.

The invention includes an anvil member which faces the blade and means to drive the blade and anvil together, both as well known in log-splitting devices, and a stripper member removably engaged with respect to the anvil member for purposes log-removal purposes. The stripper member has distal and proximal ends and a front surface which is beveled upwardly from a lower edge at the distal end toward the proximal end.

In operation, the stripper member can be quickly and easily attached to the anvil member of the log splitter, as hereafter described. In use, the power of the log-splitter drive means, such as a hydraulic drive cylinder, can act on the free end of the log through the stripper member to remove it from the blade.

As the log splitter operates, the free end of the stuck log is engaged by the beveled front surface of the stripper member and such free end moves up the beveled surface to an extent that manual removal becomes easy. As the log moves upward, it is lifted away from the blade, thereby freeing the blade for continued operation of the log splitter.

Certain preferred embodiments include a vertical center notch in the front surface in position dividing the lower edge and extending rearwardly therefrom through at least a portion of the beveled front surface. By virtue of such notch, the free end of the log tends to be kept on line during removal from the blade.

The vertical notch is preferably aligned with the blade of the log splitter, in a central position. Such positioning has the further advantage that the notch can receive the log-splitter blade when and if the stripper member approaches particularly close to the blade. The notch is most preferably V-shaped and extends about one-half the length of the beveled front surface.

In certain preferred embodiments, the beveled front surface is inclined at an angle of less than about 45 to a horizontal plane. This helps facilitate operation of the log stripping apparatus of this invention.

As noted, the stripper member is removably attached to the anvil member. To that end, the proximal end of the stripper member includes means for removable attachment to the anvil member. Such attachment means is preferably an engagement slot sized to receive an anvil member, such as the anvil itself or some underlying supporting structure.

DETAILED DESCRIPTION OF PREFERRED EMBODIMENTS

Figure 1:
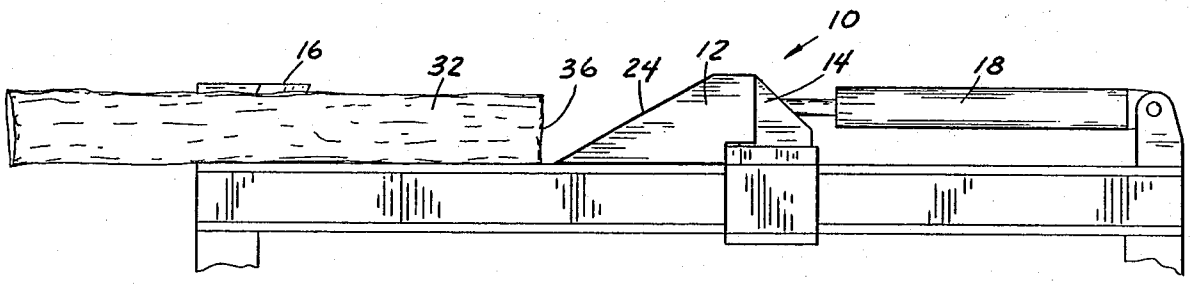
FIG. 1 is a side elevation of a preferred device in accordance with this invention used for removal of a log from the blade of a log splitter, a jammed log being shown in place prior to use of the the device.

The figures illustrate a preferred log-stripping device 10 which is a powered log splitter modified by attachment of a stripping member 12 to the anvil member 14 of the log splitter. Device 10 also includes a blade 16, and an hydraulic drive cylinder 18.

The main element of the invention is stripping member 12 which is a rigid block, preferably of high-impact plastic or metal. Stripping member 12 includes proximal and distal ends 20 and 22 and a beveled front surface 24. Proximal end 20 has an engagement slot 26 sized to receive anvil member 14. Stripping member 12 may be attached easily to anvil member 13 by slipping it over anvil member 14. Removal is just as easy. Such attachment supports stripping member 12 in proper orientation, with distal end 22 facing blade 16 and beveled front surface 24 facing up.

Beveled front surface 24 of stripping member 12 is beveled upwardly from a lower edge 28 at distal end 22 toward proximal end 20. Beveled front surface 24 extends upwardly the full height of stripping member 12.

Beveled front surface 24 has a vertical center notch 30 which divides lower edge 28 and extends rearwardly through at least a portion of beveled front surface 24. Notch 30 is preferably V-shaped and preferably extends about one-half the length of beveled front surface 24. Beveled front surface 24 is preferably inclined at an angle less than about 45° to a horizontal plane, most preferably at an angle of less than about 30 to such plane. Such angling is beneficial in log removal operations.

Vertical center notch 30 may interact with the log during stripping and in some cases it tends to keep the log in line during its removal from the blade. That is, rather than move to one side or the other, the log would tends to move reliably in an upward direction.

Vertical center notch 30 is preferably aligned with blade 16. Such arrangement allows blade 16 to be received into vertical center notch 30 when stripping member 12 and blade 16 move close to one another. This prevents the blade from engaging metal, which might be harmful to its sharp edge.

Figure 2:
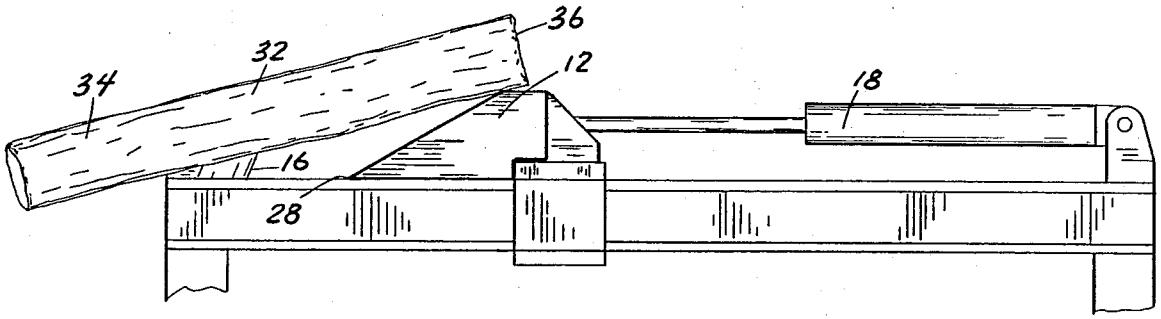
FIG. 2 is another side elevation as in FIG. 1, but illustrating the action of the device in removing a stuck log.
Figure 3:
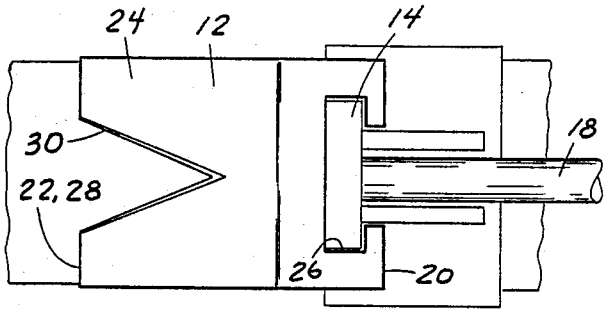
FIG. 3 is an enlarged fragmentary top view of FIG. 1, illustrating details of the preferred stripper member used in this embodiment.
Figure 4:
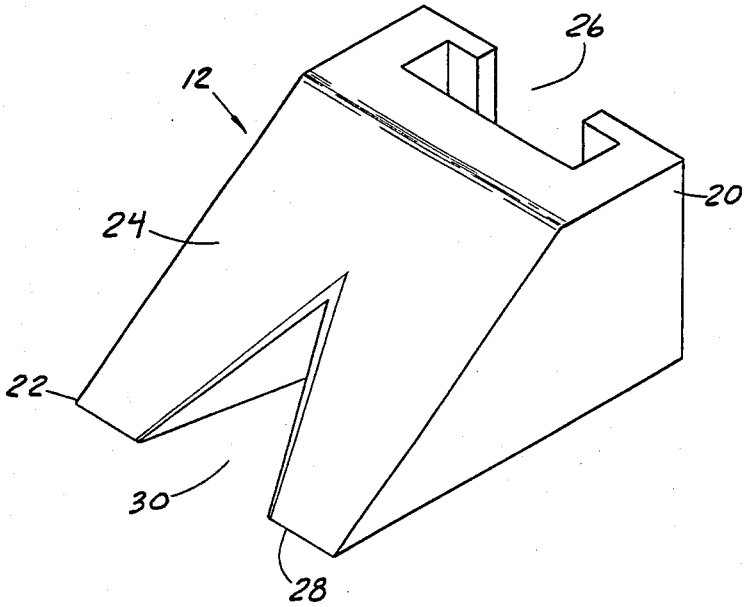
FIG. 4 is an enlarged perspective view of FIG. 3.

FIGS. 1 and 2 illustrate the operation of log-stripping device 10 of this invention. In FIG. 1, a log 32 is shown with one end 34 stuck or jammed on blade 16. Stripping member 12 has already been slipped over anvil member 14.

When log-stripping device 10 is operated to remove stuck log 32 from blade 30, the free end 36 of long 32 is engaged by beveled front surface 24 and a driving force is applied by drive cylinder 18 just as it is during log-splitting operations. During such relative movement, free end 36 of log 32 moves in an upward direction, as shown in FIG. 2. This continues until stripping member 12 is quite close to blade 16, at which point log 32 has been loosened from blade 16 and/or relocated on it to the extent that it can be removed by hand without difficulty. Or, the movement can be stopped as soon as it is possible to remove the log manually from blade 30.

The device of this invention can be made using well-known materials and construction methods. As noted, stripping member 12 is preferably made of high-impact plastic or metal, such as steel.

Many variations are possible in the exact shape of the stripping member. For example, its beveled front surface could be changed in a number of ways and still perform its intended function. And, a variety of removable attachment means are possible. In this regard, the term "anvil member" as used herein refers to the anvil itself or to any supporting apparatus for the anvil to which the stripping member could be attached.

While the principles of this invention have been described in connection with specific embodiments, it should be understood clearly that these descriptions are made only by way of example and are not intended to limit the scope of the invention.

I claim:

1. A device for removal of a log from a log-splitter blade, the log extending from a stuck end lodged on the blade to a free end along the splitter, comprising:

an anvil member facing the blade;

means to drive the blade and anvil together;

a stripper member removably engaged with respect to the anvil member and having distal and proximal ends, the stripper member having a front surface beveled upwardly from lower edge at the distal end toward the proximal end, whereby the power of the drive means can act on the free end of the log through the stripper member to remove it from the blade.

2. The device of claim 1 comprising a vertical center notch in the front surface dividing the lower edge and extending rearwardly therefrom through at least a portion of the beveled front surface, whereby the free end of the log tends to be kept on line during removal from the blade.

3. The device of claim 2 wherein the vertical notch is aligned with the blade of the log splitter.

4. The device of claim 2 wherein the notch is V-shaped and extends about one-half the length of the beveled front surface.

5. The device of claim 1 wherein the beveled front surface is inclined at an angle of less than about 45° to a horizontal plane.

6. The device of claim 1 wherein the proximal end of the stripper member includes means for removable attachment to the anvil member.

7. The device of claim 6 wherein the attachment means includes an engagement slot receiving the anvil member.

8. The device of claim 6 comprising a vertical center notch in the front surface dividing the lower edge and extending rearwardly therefrom through at least a portion of the beveled front surface, whereby the free end of the log tends to be kept on line during removal from the blade.

9. The device of claim 8 wherein the vertical notch is aligned with the blade of the log splitter.

10. The device of claim 8 wherein the notch is V-shaped and extends about one-half the length of the beveled front surface.

11. The device of claim 6 wherein the beveled front surface is inclined at an angle of less than about 45 to a horizontal plane.

12. A stripper device for removal from a log-splitter blade of a log which extends from a stuck end lodged on the blade to a free end along the splitter and facing a log-splitter anvil member, comprising a stripper member having a distal end and a proximal end, means at the proximal end for removable attachment of the stripper member to the anvil member, and a front surface beveled upwardly from a lower edge at the distal end toward the proximal end such that the power of a log splitter can act on the free end of the log through the stripper member to remove it from the blade.

13. The device of claim 12 comprising a vertical center notch in the front surface dividing the lower edge and extending rearwardly therefrom through at least a portion of the beveled front surface, whereby the free end of the log tends to be kept on line during removal from the blade.

14. The device of claim 13 wherein the vertical notch is aligned with the blade of the log splitter.

15. The device of claim 13 wherein the notch is V-shaped and extends about one-half the length of the beveled front surface.

16. The device of claim 12 wherein the beveled front surface is inclined at an angle of less than about 45° to a horizontal plane.

17. The device of claim 12 wherein the attachment means includes an engagement slot receiving the anvil member.

* * * * *

UNITED STATES PATENT AND TRADEMARK OFFICE

CERTIFICATE OF CORRECTION

PATENT NO. : 4,793,391

DATED : December 27, 1988

INVENTOR(S) : James J. Mauer

It is certified that error appears in the above-identified patent and that said Letters Patent is hereby corrected as shown below:

In column 2, line 53, change "45" to --45°--.

In column 3, line 38, change "30" to --30°--. In addition, the number "30" should not be in bold print.

In claim 1, line 9, change "from lower" to --from a lower--.

In claim 11, line 2, change "45" to --45°--. In addition, the number "45" should not be in bold print.

Signed and Sealed this

Twenty-third Day of May, 1989

*Attest:*

*Attesting Officer*

DONALD J. QUIGG

*Commissioner of Patents and Trademarks*